United States Patent [19]

Gulberg et al.

[11] Patent Number: 4,468,858

[45] Date of Patent: Sep. 4, 1984

[54] TOOL FOR SEPARATING MATED CONNECTORS

[75] Inventors: Norman B. Gulberg, Encinitas; Richard J. Busby, Anaheim, both of Calif.

[73] Assignee: Hughes Aircraft Company, El Segundo, Calif. ; by said Norman B. Gulberg

[21] Appl. No.: 379,394

[22] Filed: May 18, 1982

[51] Int. Cl.[3] ..... H01R 43/00

[52] U.S. Cl. ..... 29/764; 29/239; 29/278

[58] Field of Search ..... 29/764, 762, 426.5, 29/278, 239, 256

[56] References Cited

U.S. PATENT DOCUMENTS

| | | | |
|---|---|---|---|
| 3,117,370 | 1/1964 | Kauppi et al. | 29/762 X |
| 3,696,492 | 10/1972 | Baillard | 29/764 X |
| 3,759,559 | 9/1973 | Yuska | 29/764 |
| 3,903,576 | 9/1975 | Stein | 29/764 |
| 4,033,032 | 7/1977 | Romania | 29/764 |
| 4,122,599 | 10/1978 | Lunycz | 29/764 X |

*Primary Examiner*—Carl E. Hall

*Attorney, Agent, or Firm*—Lewis B. Sternfels; W. J. Bethurum; A. W. Karambelas

[57] ABSTRACT

A U-shaped body (12) receives a plunger assembly (31) including a pair of push rods (30) which are rigidly secured together by a beam (32). Springs (36) normally bias the plunger assembly rearwardly so that the rod ends and slides (40) coupled thereto are normally positioned at terminal portions (18) at the end of the U-shaped body. Movement of plunger assembly beam (32) toward the body extends plates (46) of the slides outwardly against a connector half (20*a*) for separation thereof from its mating connector half (20) in a straight-line motion to prevent bending of any electrical contacts or breakage of the connector body. A strain relief (49) and the straight-line motion also reduces the possibility of damage to any electric or electronic devices coupled to either connector half.

9 Claims, 7 Drawing Figures

Fig. 1.
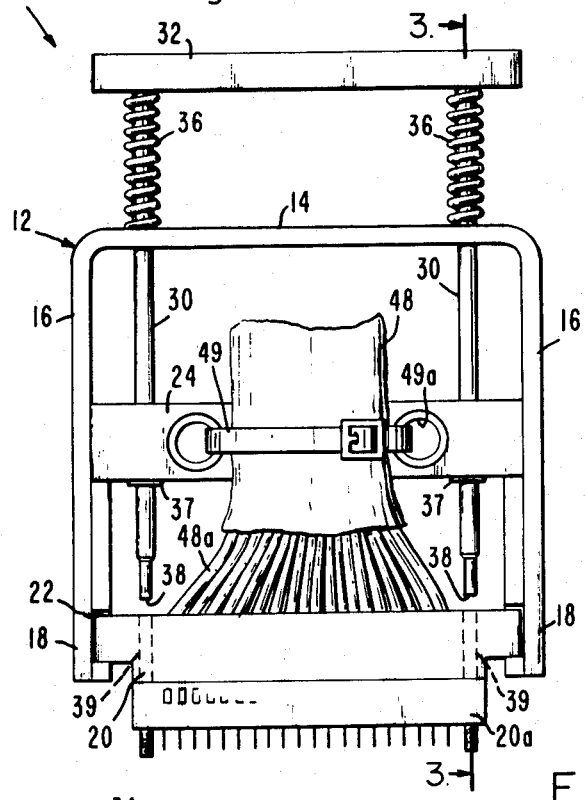
Fig. 2
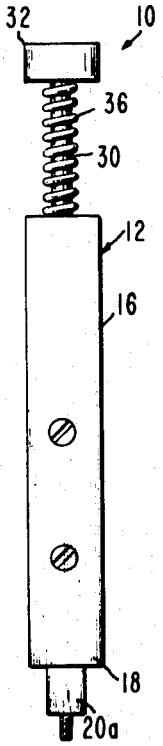
Fig. 4
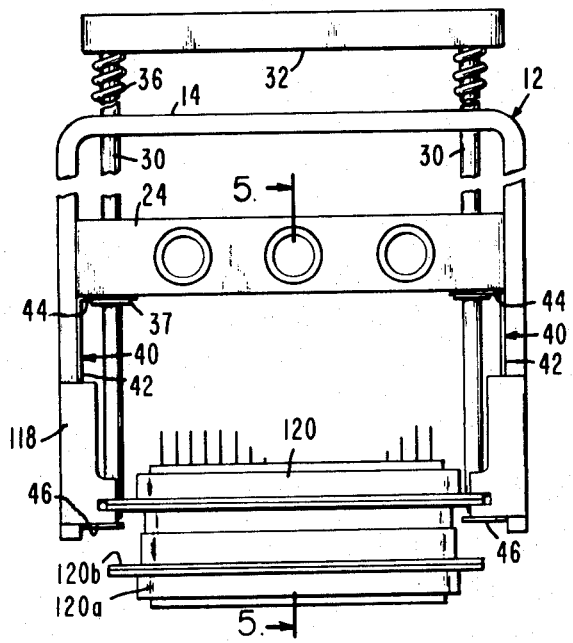
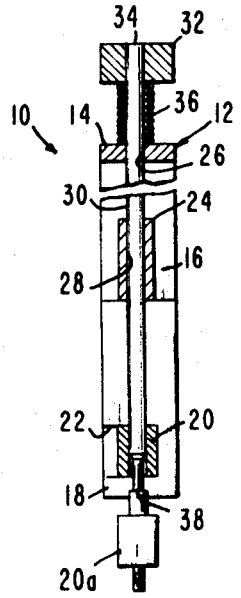
Fig. 3.

TOOL FOR SEPARATING MATED CONNECTORS

BACKGROUND OF THE INVENTION

1. Field of the Invention

The present invention relates to a tool for separating mated connectors and, in particular, to effect such separation without breaking either connector body or bending any contact therein.

2. Description of the Prior Art and Background Considerations

Connectors, in particular, electrical connectors with a large number of mating contacts, many times must be manually separated without the use of guiding hardware so that the separation will be in a straight line fashion without damage, for example, to the mating contacts, cabling or other electric or electronic devices connected to either connector half, or the connector bodies. An example of one specific use occurs frequently in testing connectors for quality assurance or quality control. Specifically, a connector secured to a unit under test is coupled to an adapter test cable connector. After the test, the two connectors are separated. Without the aid of such guiding hardware, it is generally the practice to rock one connector half with respect to the other in order to separate them in incremental steps. Damage is almost ensured when the interconnection between mating contacts is snug and when there are a large number of mating contacts. One source of damage arises when one connector half is rocked with respect to the other, and results from the bending moment placed on the contacts. Another source of damage occurs when alignment pins are rocked back and forth in their mating holes and stress the connector body sufficiently to crack, break or chip its dielectric material. Additional breakage results from the use of a screwdriver or similar tool to pry the two connector halves apart.

Further damage to such electronic or electric devices as circuitry or cabling attached to the connector occurs during separation of the connectors by stress, bending and the like or the pressure on the attached device which may break or damage its attachment or the device itself, i.e., the cable, flex circuit, backplane, printed wiring board, circuit connections, or components. Since many connectors and attached devices and/or their repair are expensive, it is obvious that much care should be taken to avoid any damage.

Different concepts for separating devices have been devised for specific problems relating to vacuum tubes, individual electric contacts or insulators therafor, circuit modules and main frame plug-in components, e.g., as described in U.S. Pat. No. 2,513,821, No. 3,087,235, No. 3,443,297, No. 3,453,586 and No. 3,951,514. However, none are directed to avoid or overcome at least collectively the specific problems outlined above which are peculiar to mating connectors having backplane, cabling and the like devices attached thereto. One further U.S. Pat. No. 3,117,370, while directed to electric connectors specifically, is complex and expensive. What is required is a simple and inexpensive, yet effective, and reliable connector separation tool.

SUMMARY OF THE INVENTION

The present invention avoids and overcomes these and other problems by use of a specially made tool. The tool includes a body to which one connector half (e.g., an adapter test cable connector) is secured or held captive and a pair of push rods which are extendable beyond the captive connector half. When the rod termini are extended, they push the mating connector half (e.g., attached to a unit under test) linearly away from the captive connector half rather than in a rocking fashion. The push rod termini may comprise squared ends to provide simple flat surfaces, or plates or other enlargements may be contacted by the termini to provide larger surfaces for contact with the connector half to be separated. The cable or other component, which is secured to the captive connector, may be lashed or otherwise secured to the body to provide a strain relief of forces otherwise exerted against the cable or component connection to the captive connector.

Several advantages are derived therefrom. Primarily, bending of mating contacts and breakage of the connector bodies in which the contacts are housed is eliminated. Relief against strain on any cables, components or other electric or electronic devices attached to the connector is provided. Unmating occurs with relative great speed and ease, even between large numbers of contacts and/or tightly connected contacts.

Other aims and advantages, as well as a more complete understanding of the present invention, will appear from the following explanation of exemplary embodiments and the accompanying drawings thereof.

BRIEF DESCRIPTION OF THE DRAWINGS

FIG. 1 is a front elevational view of a first embodiment of the invention showing connector halves mated prior to separation;

FIG. 2 is a side elevational view of the embodiment depicted in FIG. 1;

FIG. 3 is a side view in cross-section taken along lines 3—3 of FIG. 1, but after connector separation;

FIGS. 4 and 5 illustrate a second embodiment of the invention, viewed similarly as the embodiment of FIGS. 1 and 3, with FIG. 5 taken along lines 5—5 of FIG. 4 also after connector separation;

DETAILED DESCRIPTION OF THE INVENTION

Figure 5:
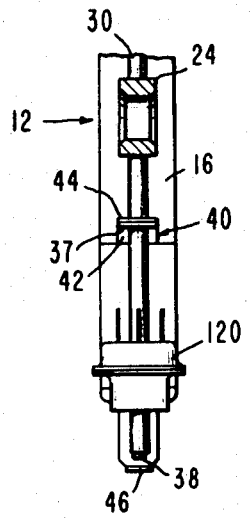

Referring to FIGS. 1 and 2, a connector separation tool 10 comprises a U-shaped body 12 including a base 14 and a pair of generally parallel legs 16, which extend from base 14 to terminal portions 18. Terminal portions 18 are configured to receive a connector half 20. The fitting is within a bracket type structure 22 and, if desired, the fitting may be replaceable with another type of fitting which is capable of accepting a differently configured connector half.

A crossbar 24 is secured to and between legs 16 generally midway between base 14 and terminal portion 18. Thus, base 14 and crossbar 24 forms body 12 into a very rigid structure. Extending through base 14 and bar 24 are aligned holes 26 and 28 through which a pair of push rods 30 of a plunger assembly 31 extend. Rods 30 are rigidly secured together by a beam 32, for example, by rivets, set screws or pins 34. It is essential that beam 32 and push rods 30 be rigidly affixed one to the other so that, when rods 30 move axially within their holes 26 and 28, they will move together in unison without appreciable wobble. Springs 36 are positioned about rods 30 and are slightly compressed between base 14 and beam 32 so that termini 38 of rods 30 are normally positioned at terminal portions 18. Movement of beam 32 toward base 14 compresses springs 36 and causes termini 38 to move forwardly of terminal portions 18 into their extended positions which pass through openings 39 in connector half 20 for contact with connector half 20*a*. Snap rings 37 or the like are secured to rods 30 and contact crossbar 24 to limit retraction of plunger assembly 31 under the compressed bias of springs 36 and to prevent complete withdrawal of the assembly from U-shaped body 12.

Depending upon the connector to be separated from connector half 20, rod termini 38 need only be flat to provide flat surfaces for some connector configurations, but in other configurations, where a hole or other part of the connector to be separated must be protected, e.g. as for connector half 120*a* (FIGS. 4 and 5), an enlargement provided by slides 40 may be employed. Each slide comprises a central flat portion 42 with flat plates 44 and 46 at either ends of flat central segment 42. End plate 44 has a hole therein so that rods 30 may extend therethrough. Plate 46 has a planar surface which is maintained normal to the linear movement of rods 30. Therefore, plates 46 will abut against a surface 120*b* of connector half 120*a* to be separated. In order to maintain proper movement and support of the slides, legs 16 have a flat surface against which flat central segment 42 rides, and a slot within terminal portions 118 may be provided for further support of the slides.

In operation, movement of beam 32 toward base 14 moves rods 30 against the action of springs 36 so that their termini move forwardly of terminal portions 18. The flat ends of the rods bear directly against connector 20*a* (FIG. 3), or through the intermediary of plates 46 of slides 40 (FIG. 5), to move the slides against connector 20*a* or 120*a*, and thus to separate it from connector half 20 or 120 with evenly applied forces at both ends of its connector 20*a* or 120*a*.

In order to provide strain relief for any cabling and its attachments to connector 20, e.g., cabling and attachments 48 and 48*a*, the cables may be held rigidly to crossbar 24 by straps 49 about the bar or through holes 49*a* therein.

Figure 6:
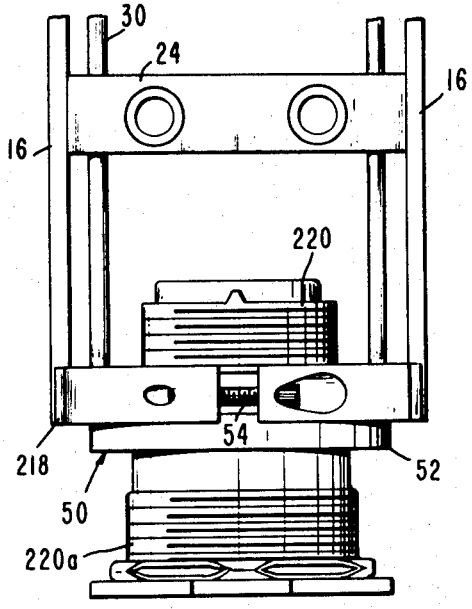
FIGS. 6 and 7 depict a third embodiment of the invention, also viewed similarly as the embodiment of FIGS. 1 and 3, with FIG. 7 taken along lines 7—7 of FIG. 6 also after connector separation.
Figure 7:
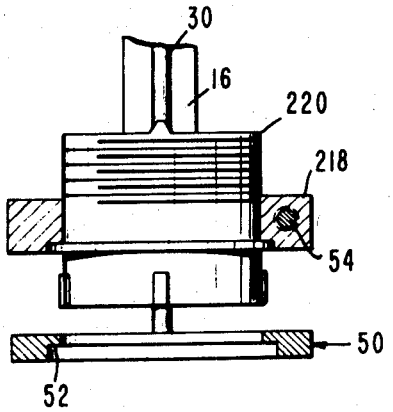

For those situations where the connectors are circular in configuration, rather than rectangular as depicted in FIGS. 1–5, reference is directed to FIGS. 6 and 7 in which elements similar to those of FIGS. 1–5 are numbered the same. In this configuration, however, for circular connectors 220 and 220*a*, small flat surfaces or plates are insufficient to provide the necessary separating force without causing non-axial or linear movement between the two connector halves. Also, there are no holes in the connector half through which the push rods may extend. Accordingly, a circular rim 50 is rigidly affixed to the termini of rods 30 at 52. Thus, a surface 52 of rim 50, which contacts connector half 220*a* to be separated, lies in a plane which is normal to the linear movement of rods 30 of the plunger assembly and, therefore, will effect a straight-line separation of the connector half to be separated. To ensure proper support for rods 30 as well as for the captive adaptor test cable connector, a split circular terminal portion 218 is secured to both legs 16. A bolt 54 clamps portion 218 about and into squeezing contact with captive connector 220 to secure and immobilize it with respect to body legs 16.

Although the invention has been described with reference to particular embodiments thereof, it should be realized that various changes and modifications may be made therein without departing from the spirit and scope of the invention.

What is claimed is:

1. A tool for separating mated connectors and their mating contacts without bending of the contacts or breakage of their connector bodies, in which electrical devices are coupled to one of the connectors, comprising:

a U-shaped body including a base and a pair of generally parallel legs extending from said base to terminal portions, said base having a pair of holes extending therethrough;

means on said terminal portions for securing the one connector to said legs;

a plunger assembly including a pair of push rods extending in parallel through the holes in said base to termini at said terminal portions, a coupling rigidly affixed to said rods for preventing independent movement thereof, and means associated with said rod termini for contact with a second of the connector halves, said plunger assembly slidable with linear movement in said U-shaped body for establishing a normal position and an extended position of said rod termini and said means associated therewith, respectively at said terminal portions and extending therefrom;

means coupled to said plunger assembly and said U-shaped body for biasing said coupling away from said base, to position said rod termini and said means associated therewith in their normal position, and to restore said rod termini and said means associated therewith to their normal position;

a crossbar parallel to said base and affixed to and between said legs for assuring rigidity of said U-shaped body, said crossbar having holes therein aligned with the holes in said base for extension therethrough of said rods and for ensuring alignment thereof; and means securing said electrical devices to said crossbar for relieving any stress exerted between said devices and said U-shaped body.

2. A tool according to claim 1 in which said means associated with said rod termini comprise flattened ends thereon.

3. A tool according to claim 1 wherein said means associated with said rod termini comprise a push plate rigidly secured thereto and having a surface residing in a plane which is normal to the linear movement of said plunger assembly for contact with said second connector half.

4. A tool according to claim 3 in which said push plate comprises a rim shaped to evenly contact a mating surface on said second connector half for straight-line separation thereof from said first connector half.

5. A tool according to claim 1 wherein said means associated with said rod termini comprise a pair of slides respectively coupled to said rods, each of said slides including a plate contactable with its rod termini and having a planar surface which is maintained normal to the linear movement.

6. A tool according to claim 5 wherein each of said slides further includes a central segment which is coupled to its rod and moveable therewith and to which said plate is secured.

7. A tool according to claim 6 in which said legs of said U-shaped body respectively have flat surfaces at their terminal portions, and said central segments of said slides are flat and slidably guided along said leg flat surfaces.

8. A tool according to claim 1 in which said terminal portion means comprise interchangeable fittings adapted to accept connector halves of different configurations.

9. A tool according to claim 1 in which said rod coupling comprises a beam and said biasing means comprises springs respectively placed about said rods and compressed between said beam and said base, and further including means secured to said rods and positioned between said crossbar and said terminal portions for retaining the engagement of said plunger assembly with said U-shaped body and for maintaining a minimum compression of said springs.

* * * * *